US009776764B2

(12) United States Patent
Lejon et al.

(10) Patent No.: US 9,776,764 B2
(45) Date of Patent: Oct. 3, 2017

(54) PACKAGING CONTAINER, AND BLANK USABLE IN THE PRODUCTION OF SUCH A PACKAGING CONTAINER

(75) Inventors: Hanna Lejon, Råå (SE); Bengt Andersson, Malmö (SE); Mats Johansson, Eslöv (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 13/825,954

(22) PCT Filed: Sep. 22, 2011

(86) PCT No.: PCT/SE2011/051137

§ 371 (c)(1),
(2), (4) Date: Mar. 25, 2013

(87) PCT Pub. No.: WO2012/044235

PCT Pub. Date: Apr. 5, 2012

(65) Prior Publication Data

US 2013/0186901 A1 Jul. 25, 2013

(30) Foreign Application Priority Data

Sep. 30, 2010 (SE) ..... 1000966

(51) Int. Cl.
*B65D 25/00* (2006.01)
*B65D 23/00* (2006.01)
*B65D 8/00* (2006.01)

(52) U.S. Cl.
CPC ..... *B65D 23/00* (2013.01); *B65D 15/22* (2013.01); *B65D 2565/385* (2013.01)

(58) Field of Classification Search
CPC B65D 23/00; B65D 23/0864; B65D 75/5833; B65D 2575/3236; B65D 15/08;
(Continued)

(56) References Cited

U.S. PATENT DOCUMENTS 2,241,834 A * 5/1941 Wentz ..... 229/125.01
3,185,373 A 5/1965 Margulies et al.
(Continued)

FOREIGN PATENT DOCUMENTS

CN 2245584 Y 1/1997
CN 201276241 Y 7/2009
(Continued)

OTHER PUBLICATIONS

Google translation of JP2008162611 A, the drawings were submitted by the Applicant, inventor is Ito Yasushisaku.*
(Continued)

*Primary Examiner* — Anthony Stashick
*Assistant Examiner* — James M Van Buskirk
(74) *Attorney, Agent, or Firm* — Buchanan, Ingersoll & Rooney PC

(57) ABSTRACT

A packaging container comprises a first portion formed of a first material or material combination mainly consisting of plastic, a second portion formed of a second material or material combination mainly consisting of a fiber based packaging laminate, and a pouring opening formed in the first portion. The second portion is provided with an arrangement for separating the entire first portion from the second portion.

20 Claims, 4 Drawing Sheets

(58) Field of Classification Search
CPC .. B65D 24/0871; B65D 24/0878; B65D 1/02; B65D 5/74; B29C 65/08; Y10S 53/02; A45D 2019/005; B31B 3/64; B31B 37/60; B65B 3/02
USPC ..... 220/501, 229, 266, 268, 4.03; 264/252, 264/257, 275; 206/484; 229/116.1, 229/123.2, 4.5
See application file for complete search history.

(56) References Cited

U.S. PATENT DOCUMENTS

| | | | | |
|---|---|---|---|---|
| 3,437,257 | A | 4/1969 | Bua | |
| 4,285,428 | A * | 8/1981 | Beddall et al. | 206/354 |
| 5,025,981 | A | 6/1991 | Schellenberg | |
| 5,139,163 | A * | 8/1992 | Diaz | 220/258.2 |
| 5,605,230 | A * | 2/1997 | Marino et al. | 206/534 |
| 7,334,682 | B2 * | 2/2008 | Goepfert | B65D 75/58 206/494 |
| 2007/0095721 | A1 * | 5/2007 | Davis | B65D 23/085 206/581 |
| 2010/0029452 | A1 * | 2/2010 | Elgebrant | 493/63 |
| 2010/0084361 | A1 | 4/2010 | Dayton et al. | |
| 2010/0282750 | A1 | 11/2010 | Mazurek | |

FOREIGN PATENT DOCUMENTS

| | | | |
|---|---|---|---|
| EP | 0 108 166 | A1 | 5/1984 |
| JP | 04-32923 | U | 3/1992 |
| JP | 2007-8532 | A | 1/2007 |
| JP | 2008-162611 | A | 7/2008 |
| JP | 2008-201465 | A | 9/2008 |
| JP | 2010-126209 | A | 6/2010 |
| RU | 2 018 470 | C1 | 8/1994 |
| WO | WO 02/070365 | A1 | 9/2002 |
| WO | WO 2005/032959 | A1 | 4/2005 |
| WO | 2007/084772 | A2 | 7/2007 |
| WO | WO 2009/001503 | A1 | 12/2008 |

OTHER PUBLICATIONS

International Search Report (PCT/ISA/210) issued on Jan. 10, 2012, by the Swedish Patent Office as the International Searching Authority for International Application No. PCT/SE2011/051137.
International-Type Search Report (PCT/ISA/201) issued on Mar. 17, 2011, by the Swedish Patent Office for Application No. 1000966-0.
Office Action issued by the Russian Patent Office on Aug. 20, 2015 in corresponding Russian Application No. 2013120001 and English language translation of Office Action (8 pages).
Extended Search Report issued by the European Patent Office on Jul. 8, 2015 in corresponding European Application No. 11829681.3 (7 pages).
Office Action issued by the Japanese Patent Office on Aug. 4, 2015 in corresponding Japanese Application No. 2013-531532, and English language translation of Office Action (7 pages).
Office Action issued by the State Intellectual Property Office of People's Republic of China in corresponding Chinese Patent Application No. 201180043851.9 dated Jul. 30, 2014, and English translation of Office Action.

* cited by examiner

PACKAGING CONTAINER, AND BLANK USABLE IN THE PRODUCTION OF SUCH A PACKAGING CONTAINER

FIELD OF INVENTION

The present invention relates to a packaging container comprising a first portion essentially being formed of a first material and a second portion essentially being formed of a second material. The present invention also relates to a method of producing a packaging container of this kind. The present invention also relates to a blank usable in the production of such packaging container.

TECHNICAL BACKGROUND

Packaging containers comprising a first portion essentially being formed of a first material and a second portion essentially being formed of a second material have been known for a long time. One example of such a packaging container is shown in EP-A1-108166. Another example of such a packaging container is disclosed in WO 02/070365 A1. The latter is a commercially available packaging container marketed by Tetra Pak under the trademark Tetra Top.

Features and methods of manufacture in regard of such types of packaging containers are thoroughly described in the above documents and in documents referred to therein.

In short the above packaging containers may comprise an essentially cylindrical container body made from a paper-based material, provided with suitable coatings or laminates, such as is described in the above applications. The container body is usually folded and sealed in one end thereof, and provided with a top portion in the opposite end. The top portion comprises an opening device. The top portion generally is made from a plastic material, which may comprise an additional barrier material to achieve barrier properties eliminating or reducing passage of light, taste or oxygen.

There are several beneficial features with the above mentioned type of packaging containers, in regard of pre-manufacture logistics, manufacture, post-manufacture logistics, storage display and user friendliness. One drawback, however, relate to post-use logistics. The packaging containers are easily collapsible, such that they may be compressed by hand and thus space efficient. From a waste management perspective it is beneficial of the two portions; plastic and paper; of the packaging container are separated and sorted into different fractions, which presently requires an action from the consumer. The application WO 2005/032959, by the present applicant, is directed towards a suggested solution the above drawback. By providing the plastic top portion of the packaging container with a weakening line the major portion of the plastic top may be separated from the paper based body portion with relative ease, which is disclosed in the above application.

SUMMARY OF INVENTION

It is thus an object of the invention to make a packaging container which in a simple manner can be sorted into different fractions in connection with the ultimate disposal, reuse or recycling.

It is also an object with the invention to keep the above-mentioned advantages with a container made of different materials to greatest possible extent.

The above mentioned objects have in accordance with the invention been achieved with a packaging container as defined by way of introduction, which has been given the characterising features that the second portion is further provided with separation means for separating the entire first portion from the second portion.

By providing the container with this separation means it will be easy to separate the two portions from each other. The use of a plastic material (having a uniform material or a number of layers) for the first portion makes it possible to e.g. form a transparent portion and/or a portion having a neck with threads and/or a portion having a rather complex shape, and the use of a fibre based packaging laminate for the second portion is convenient when it comes to making a container body provided with a printed design on it. Moreover, the laminate can readily be sealed and folded to form a tight bottom.

The possibility to remove the entire first portion is also an advantage from a waste management perspective, and several beneficial features emanate from this:

1) The remaining second portion, made of a fibre based material, may be easily compressed to occupy a small volume already in the home of the consumer, and the first portion may travel directly to a plastic-recycling step, without having to go via a carton-recycling step.

2) The first portion, the top portion of the package, may keep its shape such that it is possible to stack several top portions in each other. This is likely to occupy less space than if the top portion is divided into a "bundle" of plastic material. The first portion will also represent a significant amount of plastic which is readily collected during sorting of various plastic waste.

According to one or more embodiments of the present invention the separation means comprises a perforation, which is a convenient way of providing separation means, and in one or more embodiments this perforation extends along the entire upper circumference of the second portion. This arrangement enables a simple separation of the two portions.

The perforation may, however, also only extend along a part of the upper circumference of the second portion, as is the case for one or more embodiments of the present invention. The user may in this case utilize the perforation for initiation of separation, after which a firm grip may be achieved to finalize the separation. As a pulling force is applied the difference in tensile strength between the two portions, combined with the direction of the applied force will guide the rupture towards the interface between the first and the second portion, and it will follow the second portion along this interface. According to yet one or more embodiment this perforation follows a curved path, such that it will be easier for a user to penetrate the packaging container. In one or more of these embodiments at least one of the ends of the curved path is directed towards the first portion. In this way the initial rupture (beyond the perforation) will be directed towards the interface between the first and the second portion.

In one or more embodiments the perforation path may extend between, but not beyond or over corners of the packaging container. The corners are usually defined by crease lines, in this way the perforation will be easily accessible for the user.

According to another inventive concept the separation means may comprise a pull string, which is sandwiched, interleaved, between the first portion and the second portion. Since the pull string in this case is a major contributor to the connection between the first portion and the second portion removal of the pull string enables separation of the first and the second portion.

The present invention also relates to a packaging blank to be used in the manufacture of a packaging container in accordance with the previous description. Such packaging blank comprises at least one edge and is formed from a packaging laminate and is characterized in that it is provided with separation means adjacent to one edge thereof. The separation means may comprise any of the alternatives described above or below.

BRIEF DESCRIPTION OF THE DRAWINGS

The invention will be described in more detail with reference to the appended schematic drawings, which shows an example of a presently preferred embodiment of the invention.

DETAILED DESCRIPTION OF EMBODIMENTS

The packaging container is manufactured in accordance with the following steps:

a) a roll of a packaging laminate is cut into sheets, b) the sheets are formed into sleeves by sealing two edges to each other, c) the sleeves are slid onto a mandrel on a mandrel wheel, d) a top made of a plastic material is injection moulded onto one end of the sleeve, e) the container is ejected (standing on its top) from the moulding station to a filling station, f) the container is filled with a product, g) the bottom is formed by squeezing the open end and sealing the edge into a transversal seal, and i) the bottom is finally formed by folding flaps and sealing the flaps to the bottom surface of the bottom.

As described in WO 02/070365 A1, the container thus formed is usually provided with a closed top, being adapted to be opened by removal of a membrane covering the pouring opening. In order to facilitate the opening of the container, the transition between the membrane and the surrounding portions of the top is formed as a weakening line, i.e. a portion having a smaller wall thickness than the surrounding portions.

In another example the top is manufactured separately and welded to the sleeve portion at a later stage. The present invention is useful applicable to any packaging container having two main constituents, disregarding the method of manufacture.

Figure 1:
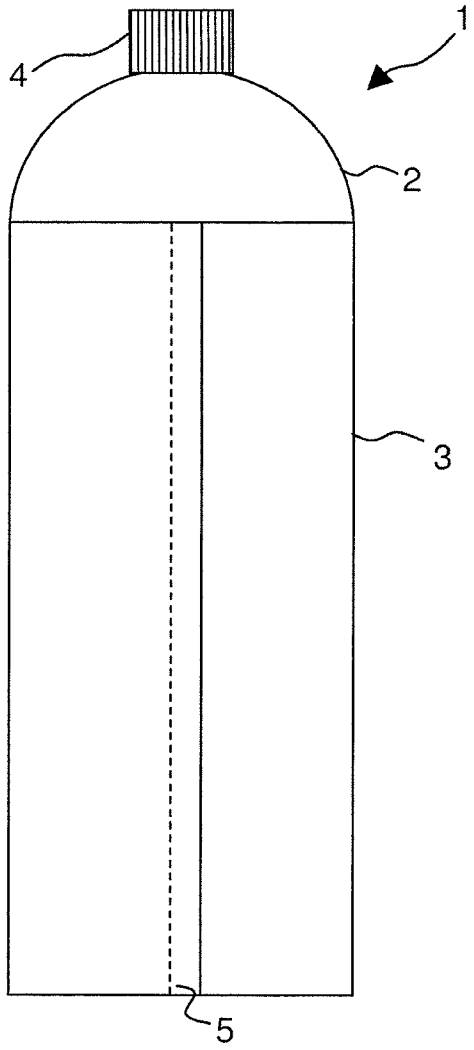
Fig. 1 (PRIOR ART)
FIG. 1 is a side view of a prior art packaging container.

FIG. 1 discloses a packaging container 1 having a first portion, a top 2, made of a plastic material and a second portion, a sleeve 3, made of a fibre based packaging laminate. The container 1 is made using the method mentioned above, where a sleeve 3 is put on a mandrel and a top 2 is injection moulded directly onto the sleeve 3. Two edges of a packaging blank, or sheet, are joined along a longitudinal seal 5 to form the sleeve 3, i.e. the main body of the packaging container 1. The top 2 is provided with a spout formed in the same piece, and a screw cap 4 arranged thereon. Optionally a pour opening (not shown) of the spout is provided with a membrane (not shown), formed in the same piece therewith. Reference is made to WO 02/070365 A1 for a deeper understanding of a commercially available container having the above features.

The material used for the sleeve 3 may be a paper based or fibre based laminate, i.e. a paper core or fibre core with a laminated plastic film on both surfaces thereof. One or several additional layers of e.g. metal foil and plastic may be added to the sandwiched laminate structure of the packaging material. The packaging material is cut into sheets of suitable size, and therefore the paper core or fibre core may be exposed along the edges of the sheet. In most cases the top 2 is therefore arranged to cover the top edge of the sleeve 3 completely, since the core layer would otherwise tend to absorb moisture from inside the container or from the surrounding environment.

The end of the sleeve 3 opposite to the end to which the top 2 is arranged is sealed and folded in a suitable way. This may be done in several ways and along several patterns, depending on the desired shape of the resulting packaging container 1.

In the following detailed description of embodiments components have been numbered following the logic:

XYY, where X is a number indicating a specific embodiment ("1" for the first embodiment "2" for the second etc) and YY is a number indicating the type of component ("02" for the top, "03" for the body, "06" for perforation means, etc)

Figure 2:
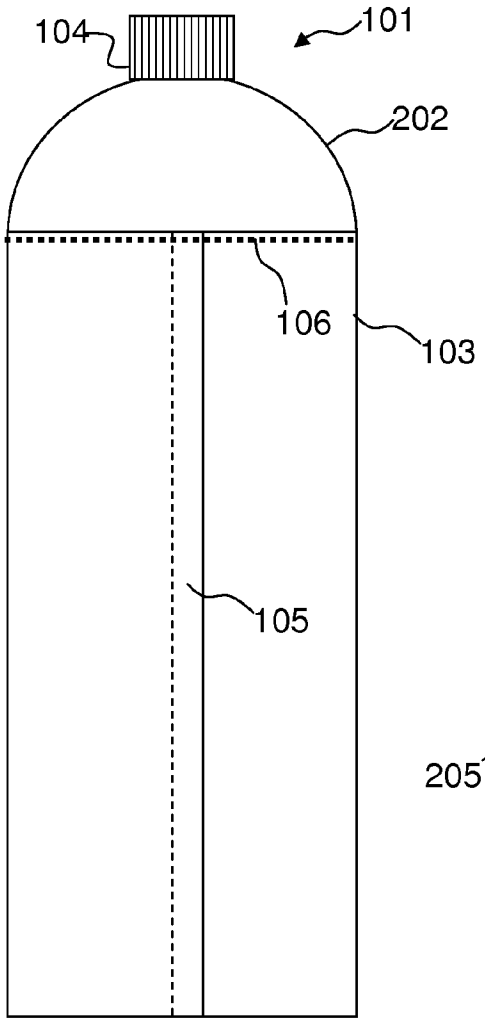

FIG. 2 is a side view of a packaging container 101 in accordance with a first embodiment of the present invention. Similarities with the previously described packaging container of FIG. 1 are obvious and like details have been given reference numbers in accordance with the above definition and will not be discussed any further. The packaging container 101 of FIG. 2 is provided with a separation means 106 along an upper end of the container body 103, basically as close to the upper end as possible. In the embodiment of FIG. 2 the separation means is provided in the form of a perforation 106, extending around the entire circumference of the sleeve 103. A perforation 106 may have the advantage of being manufactured with relative ease, yet there is a delicate balance between obtaining a tearable perforation while maintaining the integrity of the packaging container 1, such that a desired degree of hygiene or "sterility" may be maintained guaranteeing a desired shelf life for the product contained therein. The perforation 106 may obviously not penetrate the sleeve completely, and generally it fully or partially penetrates the paper core only. Plausible techniques for accomplishing the perforation are punching with a punching tool or by using laser penetration, both previously used on packaging material. The perforation is arranged prior to the arrangement of laminated layers onto the paper core.

A consumer may thus easily tear the entire top portion 102 from the body portion 103 and dispose of them in accordance with local requirements on waste management.

Figure 3:
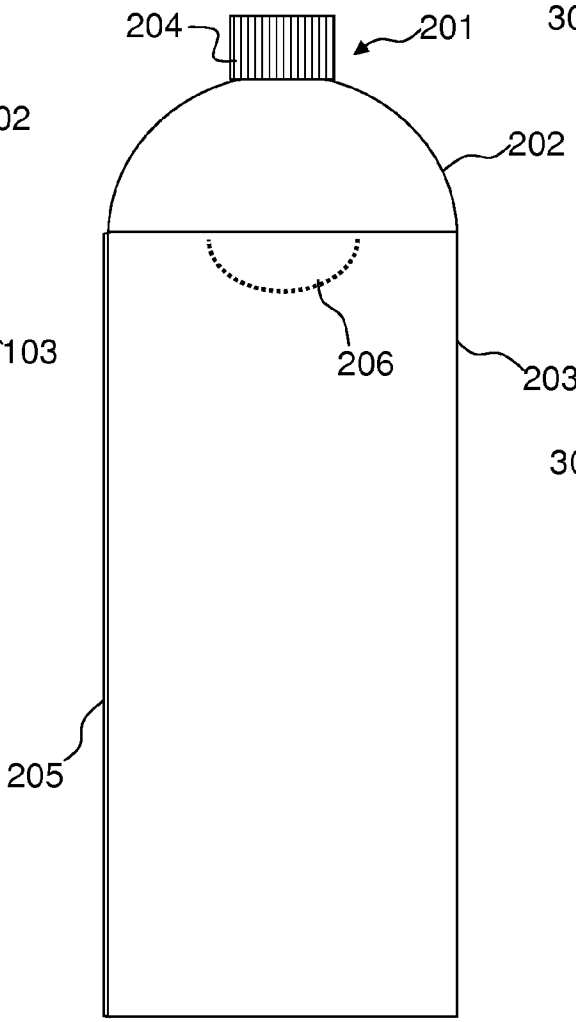

In a second embodiment shown in the side view of FIG. 3 the separation means consists of a perforation 206 extending over only part of the upper portion of the sealed and folded packaging container. In this particular example the perforation follows a curved path, with a single bulge directed towards the bottom of the container 201. The extension of the perforation path 206 in the vertical direction, i.e. in the width direction of the container 201 is smaller than the width of the side on which it is arranged. When performing the separation a user will suggestively push one or more fingers through the opening, take a firm grip of the edge of the plastic top portion 202 of the packaging container, hold the sleeve portion 203 of the container with the other hand, and separate the two portions by application of a pulling force. The direction of the pulling force and the direction of the ends of the perforation path 206 will direct the resulting tear line towards the interface between the sleeve portion 203 and the top portion 202. In embodiments similar to that illustrated in FIG. 3 the curved portion in the area of a symmetry line may follow a sharper or smoother curve than what is illustrated in FIG. 3. Since the material of the top portion 202 is harder to tear than the material of the sleeve portion 203 the two portions will separate along the interface thereof. In other embodiments it may be preferred to use another technique for separation the two portions from each other. Examples include grabbing the top portion with one hand and the sleeve portion with the other and applying a twist, or flattening the container such that a tear may be initiated at a flattened end thereof.

Figure 4:
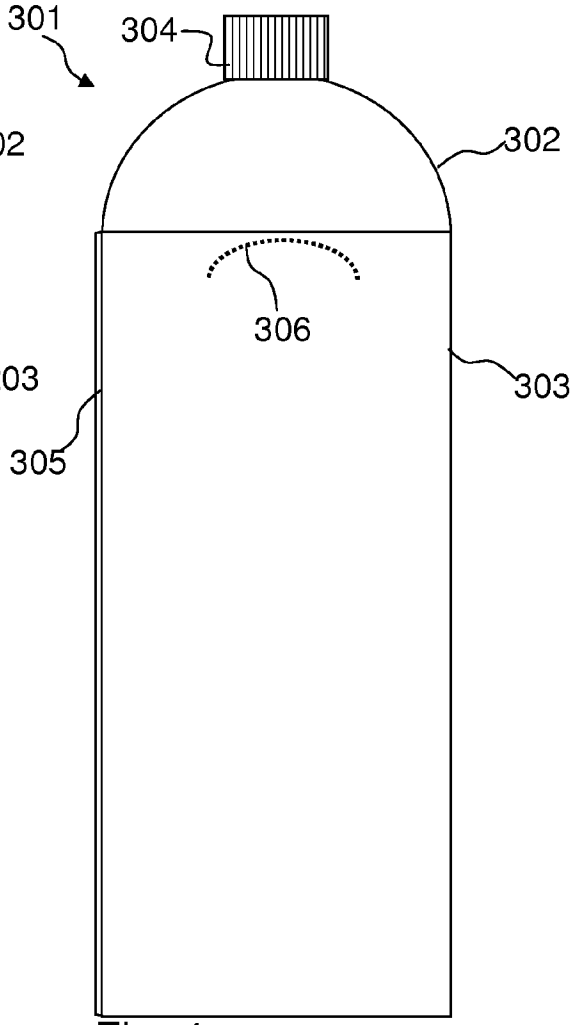
FIGS. 2-4 are side views of packaging containers in accordance with embodiments of the present invention.

The third embodiment, as shown in FIG. 4, shares most features with the second embodiment and illustrates that the shape of the perforation path may vary, e.g. to be turned upside down 306 as compared to the second embodiment. Further description of this embodiment should not be necessary.

Figure 8:
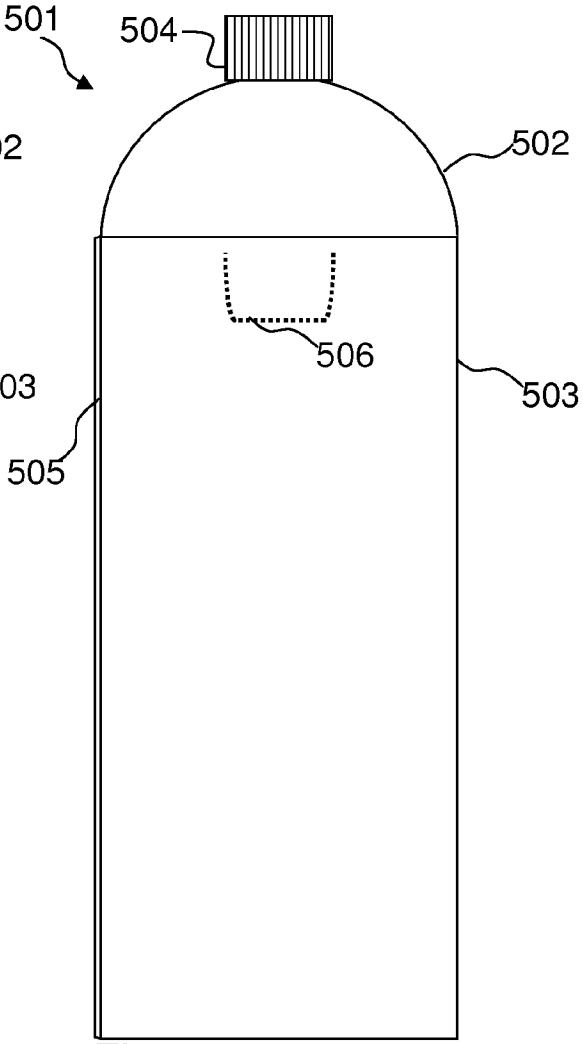
FIGS. 7 and 8 are drawings similar to FIGS. 2-4, yet of further embodiments of the present invention.
Figure 7:
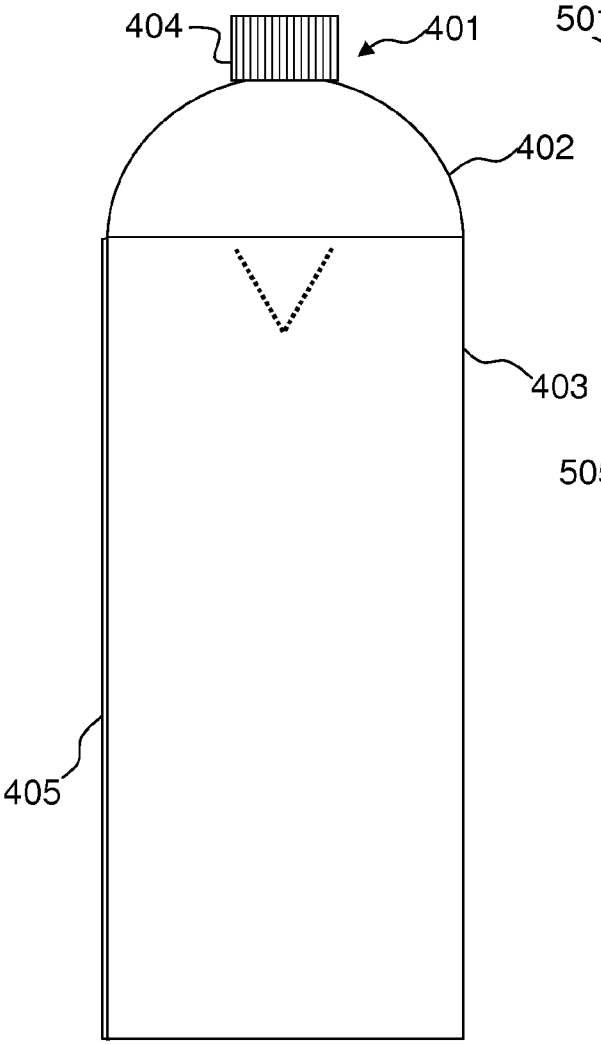

The skilled person realizes that in embodiments similar to those of FIGS. 3 and 4 the curved path may comprise rectilinear segments, such as two segments forming a single angle, three segments forming two angles, etc while remaining within the scope of the present application as defined by the claims. Examples of such paths includes; triangular—with one side missing—or rectangular—with one side missing—and so forth. This is exemplified in the embodiments of FIG. 7, showing a perforation of essentially triangular shape, and FIG. 8, showing a perforation with an essentially rectangular shape though with smoothly curved sides extending upwards outwards towards the top portion of the container. In other embodiments the two sides may be parallel; the entire shape may be directed differently, etc.

Figure 5:
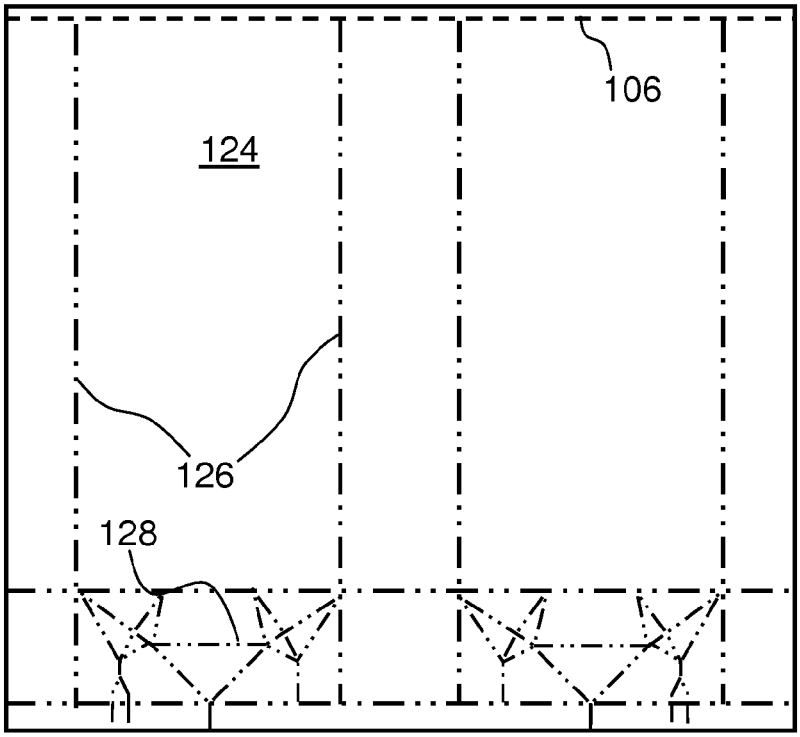
FIG. 5 is a plan view of a packaging blank for a packaging container in accordance with the embodiment of FIG. 2.

According to yet other aspects of the present invention it also relates to packaging blanks for forming the sleeve of packaging containers in accordance with the embodiments described above and generalizations thereof. To this end FIG. 5 is a plan view of a packaging blank intended for a packaging container in accordance with the first embodiment. The packaging blank 124 comprises vertical crease lines 126 which will help defining the corners of the resulting packaging blank, as well as crease lines 128 which will help define the folds necessary when folding and sealing the bottom of the resulting packaging container. The skilled person realizes that the position and design (and in some cases the mere existence) of these crease lines will vary with the design of the resulting packaging container, and therefore the specific crease lines 126, 128 should not limit the scope of the present invention as defined by the appended claims. Also, crease lines as such, e.g. how and why they are applied to a packaging material are considered to be well known for the skilled person and it will not be discussed in greater detail in the present application. The packaging blank of FIG. 5 further comprises a perforation 106 following a rectilinear path along an edge of the packaging blank 124.

Figure 6:
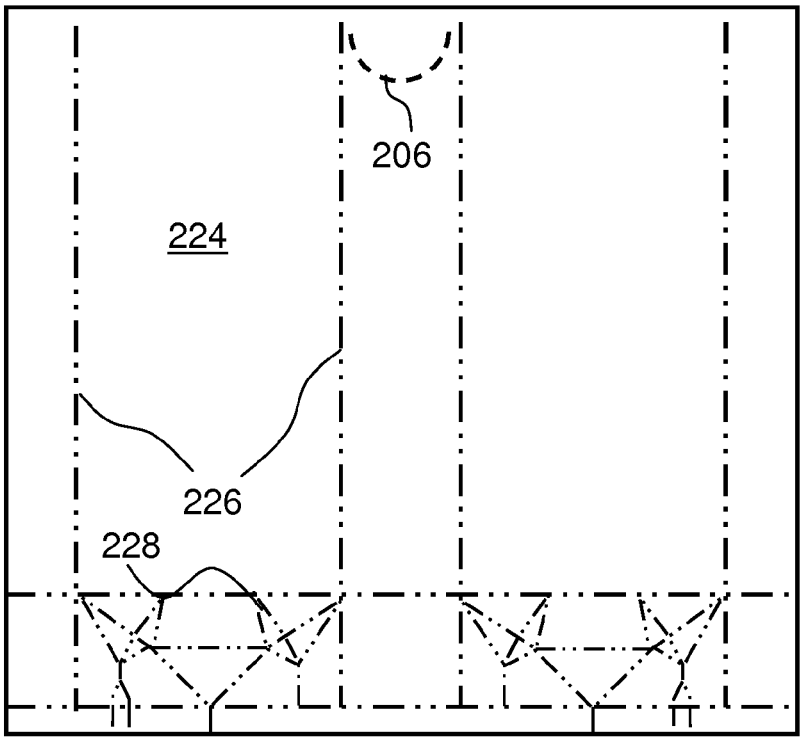
FIG. 6 is a plan view of a packaging blank for a packaging container in accordance with the embodiment of FIG. 3.

FIG. 6 is a view similar to FIG. 5, yet for a packaging blank 224 intended for a packaging container in accordance with the embodiment illustrated and described in reference to FIG. 3. In this embodiment the perforation 206 follows a curved path, and only extends over a part of the edge of the packaging blank 224.

One example of a packaging laminate suitable for the use in a container of the described kind comprise from the inside out; a plastic layer of polyethylene (PE) or metallized PE, a paper layer and an outer layer of polyethylene. In some cases an aluminum layer and an additional polyethylene layer is placed between the inside of the paper layer and the inside polyethylene layer. Of course different plastic materials can be used. It is also common knowledge to add binders to interconnect adjacent layers. According to any described embodiment the container is preferably adapted to contain liquid content.

In any one of the disclosed embodiments the perforation may be arranged at a distance from the edge of the second portion, such as not to be affected by the welding of the first portion to the second portion. A suitable distance may be about 5 mm for portion of the perforation being closest to the edge, yet this distance may vary between applications. Further it is contemplated that the perforation may be non-uniform along the extension of the perforation, in particular that the amount of non-affected or non-penetrated material per length unit varies along the extension of the perforation. The effect of this feature is that the force needed to cause a rupture of the perforation will be variable by means of varying the design of the perforation. One example is that there is less unaffected material in the area of initial rupture, such that it will be easy for a consumer to imitate the tear. In the embodiment of FIG. 3 this would correspond to the portion of the perforation being closest to the bottom of the container. After the tear has been imitated the amount of unaffected packaging material per length unit may increase, to the benefit of the container integrity.

One example of a plastic material suitable for use in the top of the container of the described kind is polyethylene with different kinds of pigment to the get the desired colouring. One advantage with using the same basic plastic in the plastic layers of the laminate and in the top is that they will fuse together during production and provide a liquid tight seal around the paper core.

It is contemplated that there are numerous modifications of the embodiments described herein, which are still within the scope of the invention as defined by the appended claims.

The invention claimed is:

1. Packaging blank to be used in the manufacture of a packaging container, the packaging container comprising (i) a first portion formed of a first material or material combination mainly consisting of plastic, (ii) a second portion formed by the packaging blank, and (iii) a pouring opening formed in the first portion;

the packaging blank being formed of a second material or material combination comprising a fibre based packaging laminate, the packaging blank comprising at least one edge; and the packaging blank being provided with separation means adjacent to the at least one edge of the packaging blank for separating the entire first portion from the second portion when the packaging blank is a part of the packaging container, the separation means comprising a perforation extending along only part of the at least one edge so that the perforation extends along a part of an upper circumference of the second portion when the packaging blank is a part of the packaging container, the perforation following a non-linear path.

2. The packaging blank of claim 1, wherein the perforation extends between but not beyond two adjacent crease lines of the packaging blank.

3. The packaging blank of claim 1, wherein the perforation is non-uniform along the extension of the perforation such that the amount of non-affected or non-penetrated material per length unit varies along the extension of the perforation.

4. The packaging blank of claim 1, wherein the perforation follows a curved path.

5. The packaging blank of claim 1, wherein at least one end of the non-linear path is directed towards the at least one edge.

6. The packaging blank of claim 1, wherein the non-linear path is U-shaped.

7. The packaging blank of claim 1, wherein the non-linear path is V-shaped.

8. The packaging blank of claim 1, wherein the non-linear path is in a shape of a rectangle with one side missing.

9. A packaging container comprising:

a first portion formed of a first material or material combination mainly consisting of plastic;

a second portion formed of a second material or material combination comprising a fibre based packaging laminate;

a pouring opening formed in the first portion, the second portion possessing a circumferential extent, the second portion which is formed of the second material or material combination comprising a fibre based packaging laminate including a perforation allowing separation of the entire first and second portions from one another;

the perforation extending only along a part of the circumferential extent of the second portion; and the perforation extending along a non-linear path.

10. The packaging container of claim 9, wherein at least one end of the non-linear path is directed towards the first portion.

11. The packaging container of claim 9, wherein the extension of the perforation in a width direction on the side of the packaging container where it is located is smaller than the extension of the side of the packaging container in the same width direction.

12. The packaging container of claim 9, wherein the perforation is non-uniform along the extension of the perforation such that the amount of non-affected or non-penetrated material per length unit varies along the extension of the perforation.

13. The packaging container of claim 9, wherein the second portion comprises a fibre-based core provided with liquid repellent layers on either side thereof, and wherein the perforation is arranged in the fibre-based core only.

14. The packaging container of claim 9, wherein the first portion is fused to the second portion by moulding or welding.

15. The packaging container of claim 9, wherein the perforation follows a curved path.

16. The packaging container of claim 9, wherein the perforation extends along less than half of the circumferential extent of the second portion.

17. The packaging container of claim 9, wherein the non-linear path comprises a bulge directed away from the first portion.

18. The packaging container of claim 9, wherein the non-linear path is U-shaped.

19. The packaging container of claim 9, wherein the non-linear path is V-shaped.

20. The packaging container of claim 9, wherein the non-linear path is in a shape of a rectangle with one side missing.

* * * * *